United States Patent [19]

Melton et al.

[11] Patent Number: 5,050,579

[45] Date of Patent: Sep. 24, 1991

[54] COMBUSTOR ASSEMBLY FOR A FUEL-BURNING ROOM HEATER

[75] Inventors: James E. Melton; William E. Edmondson, both of Sweetwater, Tenn.

[73] Assignee: Vestal Manufacturing Company, Sweetwater, Tenn.

[21] Appl. No.: 508,843

[22] Filed: Apr. 12, 1990

[51] Int. Cl.[5] ..... F24C 1/14

[52] U.S. Cl. ..... 126/77; 126/58; 110/211; 110/214; 422/177; 422/180

[58] Field of Search ..... 126/58, 77; 422/176, 422/177, 180; 110/211, 214; 60/299, 301

[56] References Cited

U.S. PATENT DOCUMENTS

| | | | |
|---|---|---|---|
| 3,043,245 | 7/1962 | Hebert et al. | 422/177 |
| 4,363,785 | 12/1982 | Willson | 422/180 |
| 4,385,031 | 5/1983 | Fratzer et al. | 422/176 |
| 4,479,921 | 10/1984 | Allaire et al. | 422/180 |
| 4,580,546 | 4/1986 | Barnett | 422/176 |
| 4,827,852 | 5/1989 | Piontkowski | 422/177 |

*Primary Examiner*—Carroll B. Dority

*Attorney, Agent, or Firm*—Luedeka, Hodges, Neely & Graham

[57] ABSTRACT

A pollutant-controlling combustor assembly for use with a fuel-burning room heater includes at least two combustors through which gaseous combustion products are routed before being discharged into the atmosphere. Each combustor has a downstream side through which combustion products exit the combustor, and the combustors are arranged so that the downstream side of each combustor is fully exposed to the downstream side of every other combustor in the assembly. In addition, the downstream sides of the combustors are positioned about a common space so that combustion products which exit the downstream sides of the combustors enter the common space.

20 Claims, 4 Drawing Sheets

COMBUSTOR ASSEMBLY FOR A FUEL-BURNING ROOM HEATER

BACKGROUND OF THE INVENTION

This invention relates generally to equipment used for controlling pollutants contained within gaseous combustion products and relates more particularly to pollutant-controlling combustors used in connection with fireplaces, stoves, and the like.

It is known that in order to control emission levels of various pollutants contained within the gaseous combustion products of fuels burned within a fireplace, stove or other room-heating apparatus or appliance, one or more pollutant-controlling combustors may be mounted adjacent the flue of the apparatus or appliance so that the gaseous combustion products which move toward the flue are routed through the combustors. The combustors include catalysts which, during operation, promote the burning or oxidation of constituents of the combustion products, such as hydrocarbons, which are broadly referred to by the United States Environmental Protection Agency as particulate material. Because of the burning or oxidizing function of the combustors, the effectiveness of the combustors to control pollutants is normally greater at higher operating temperatures than it is at lower operating temperatures.

Each combustor commonly includes a box-like housing having an upstream side through which combustion products enter the combustor and a downstream side through which combustion products exit the combustor. In applications involving a plurality of combustors, the combustors may be arranged in either a series or a parallel flow relationship so that the flow of combustion products may be routed in sequence through all of the combustors or distributed between the combustors before the products are discharged to the atmosphere.

As fuels are burned within a room-heating appliance or apparatus, combustion products are generated more rapidly at higher fuel burn rates than they are at lower burn rates. Consequently, combustor arrangements intended for use at the higher burn rates must accommodate the high volume of combustion products which flow toward the flue. In this connection, environmental regulations have evolved which require a minimum area of combustor surface for handling the combustion products generated at the higher burn rates. However, the pollutant-controlling effectiveness of combustor arrangements intended for use at the higher burn rates is reduced when used at the lower burn rates. Such a reduction in effectiveness is due, at least in part, to the better operating effectiveness of the combustors at higher operating temperatures, which temperatures may not be reached at the lower burn rates.

Accordingly, it is an object of the present invention to provide a new and improved combustor assembly for a fuel-burning room heater having a plurality of combustors of the aforedescribed class and wherein the operating effectiveness of the combustors is enhanced over a broad range of operating temperatures.

Another object of the present invention is to provide such a combustor assembly wherein the operating effectiveness of its combustors is relatively high at both higher and lower fuel burn rates.

Still another object of the present invention is to provide such a combustor assembly which is relatively compact in size and uncomplicated in construction.

Yet another object of the present invention is to provide a firebox/combustor assembly combination which utilizes such a combustor assembly.

SUMMARY OF THE INVENTION

This invention resides in a pollutant-controlling combustor assembly for use with a fuel-burning room heater so that gaseous combustion products which are generated within the room heater are directed through the combustor assembly before being discharged into the atmosphere.

In one aspect of the invention, the combustor assembly includes at least two combustors wherein each combustor includes an upstream side through which combustion products enter the combustor and a downstream side through which combustion products exit the combustor. The assembly also includes support means for supporting the combustors in parallel flow relationship and so that the downstream side of one combustor is exposed to the downstream side of another combustor.

In another aspect of the invention, the combustor assembly is combined with a firebox for a fuel-burning room heater wherein the firebox has a cavity within which fuels are burned and gaseous combustion products are generated and means defining an exhaust outlet through which the gaseous combustion products exit the firebox. The combustor assembly is disposed generally between the firebox cavity and the exhaust outlet so that gaseous combustion products which flow from the firebox cavity toward the exhaust outlet are conducted through the combustor assembly.

DETAILED DESCRIPTION OF THE ILLUSTRATED EMBODIMENTS

Figure 1:
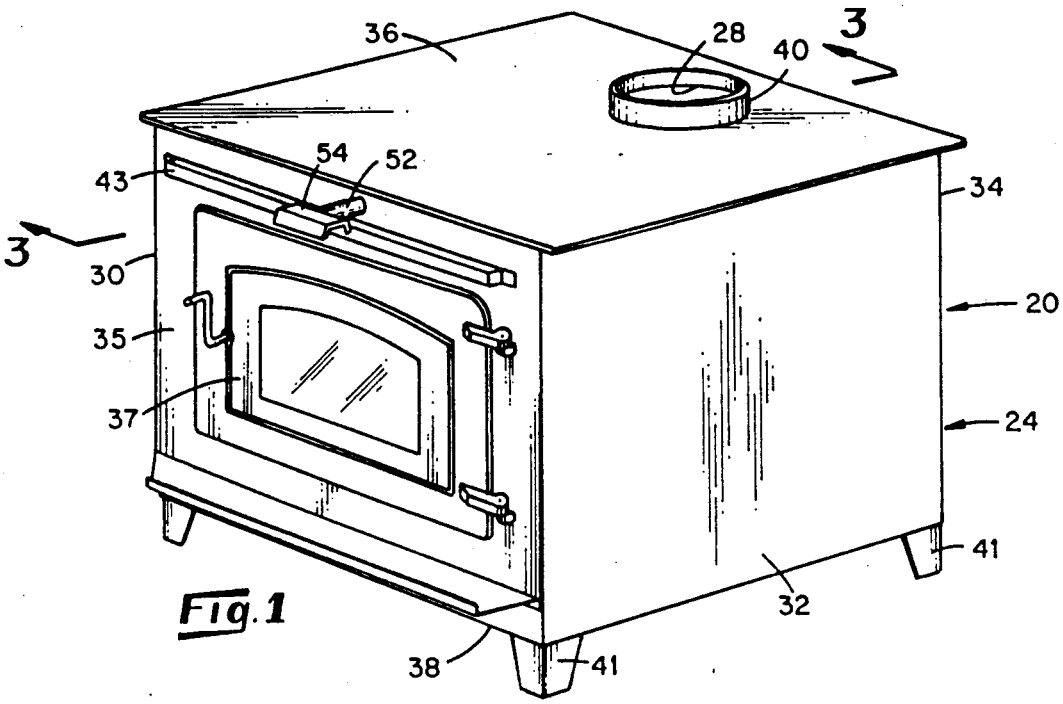
FIG. 1 is a perspective view of a fuel-burning radiant heater within which an embodiment of a combustor assembly is incorporated.
Figure 2:
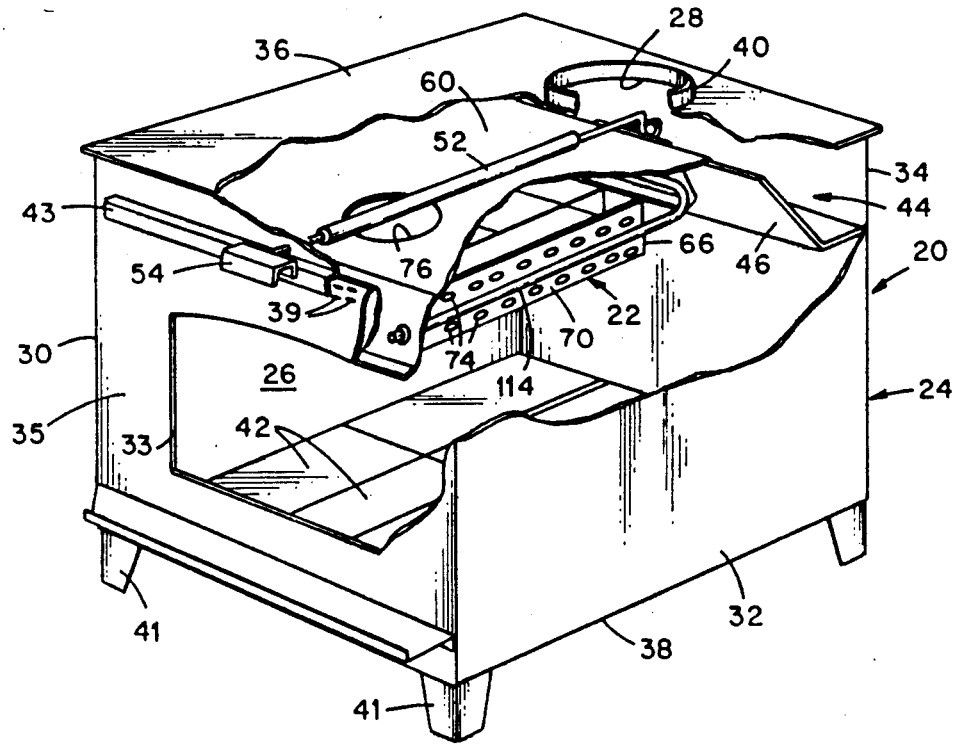
FIG. 2 is a view of the FIG. 1 heater similar to that of FIG. 1 with its front door removed and having portions cut-away.

Turning now to the drawings in greater detail, there is illustrated in FIGS. 1 and 2 a radiant heater, generally indicated 20, of a type commonly placed within a room for providing a cavity 26 within which fuels are burned. The heater 20 includes a firebox 24 and a combustor assembly 22 mounted adjacent the top of the firebox 24, and an exhaust outlet 28 is provided in the top of the heater 20 for suitable connection to a flue (not shown). As will be apparent herein, the combustor assembly 22 is disposed generally between the firebox cavity 26 and the exhaust outlet 28 so that gaseous combustion products which are generated within the firebox cavity 26 as fuels are burned therein and which flow toward the exhaust outlet 28 are conducted through the combustor assembly 22.

The depicted heater 20 is adapted to burn solid fuels, such as firewood, within its firebox 24 and is used to heat a room within which it is placed primarily by radiant heat emitted from its outer surfaces. It will be understood, however, that combustor assemblies in accordance with the present invention may be incorporated within stoves or other room-heating appliances which burn liquid fuels and/or which are intended to heat a room within which it is placed by forced air circulation. Accordingly, the principles of the present invention may be variously applied.

The firebox 24 includes two opposite side panels 30, 32, a back panel 34, a front panel 35, a top panel 36, a bottom panel 38 and a plurality of support legs 41. Each of the firebox panels is suitably joined along its edges to the edges of an adjacent panel to provide the cavity 26 within which fuels are burned. The exhaust outlet 28 is defined in the top panel 36, and a collar 40 is positioned about the outlet 28 to facilitate the connection of the outlet 28 to a flue. The front panel 35 defines an access opening 33 to the firebox cavity 26, and this access opening 33 may be opened or closed by a door 37. The front panel 35 also includes a plurality of openings 39 disposed above the access opening 33 as illustrated in FIG. 2, and these openings 39 are protectably covered by a cover plate 43 which is supported across the front panel 35 in a spaced relationship with the openings 39. The bottom panel 38 of the firebox 24 is lined with firebrick 42.

Figure 3:
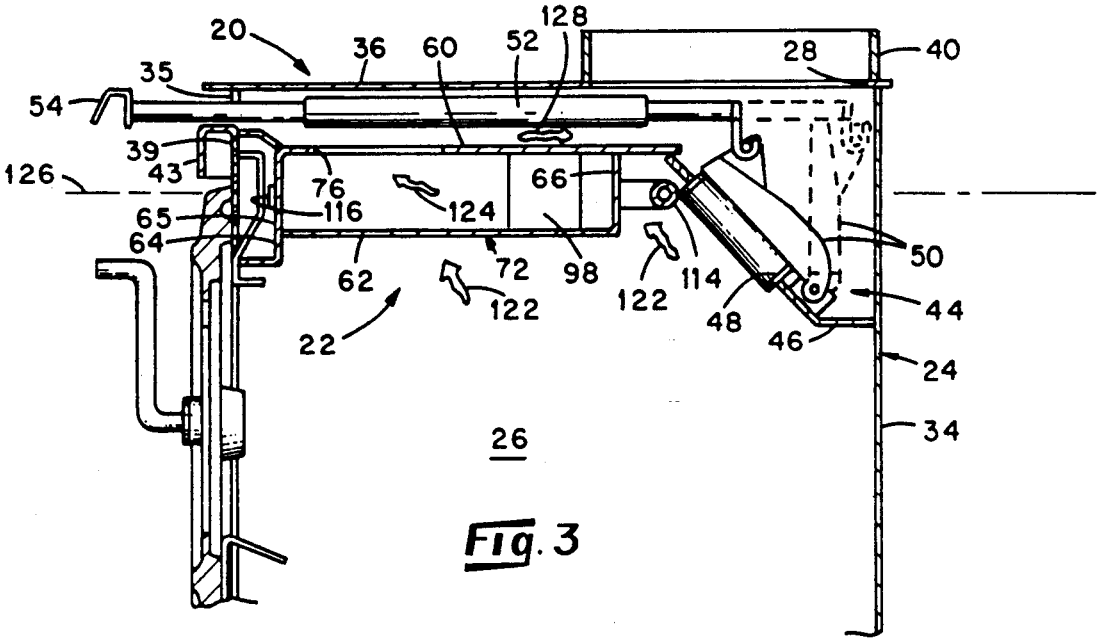
FIG. 3 is a fragmentary cross-sectional view taken about on line 3—3 of FIG. 1.
Figure 4:
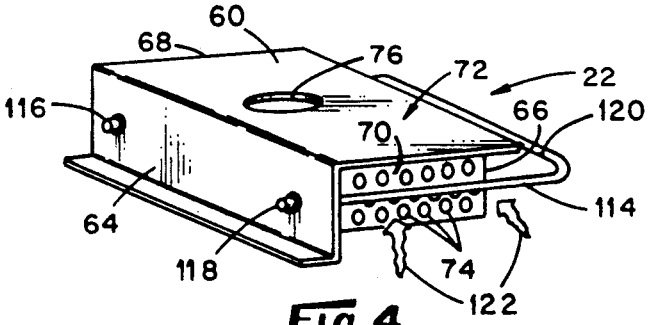
FIG. 4 is a perspective view of the combustor assembly of the FIG. 1 heater shown removed from the remainder of the heater.
Figure 5:
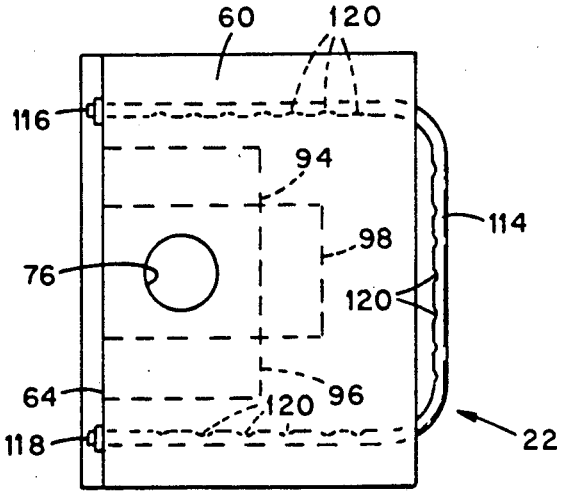
FIG. 5 is a top plan view of the FIG. 4 combustor assembly.

With reference to FIGS. 2 and 3, the heater 20 includes a by-pass damper assembly 44 disposed generally beneath the exhaust outlet 28 to permit a user to selectively open or close off direct flow communication between the firebox cavity 26 and the exhaust outlet 28. The damper assembly 44 includes a damper plate 46 having a centrally-positioned rectangular opening 48 and is suitably attached along its edges in a canted orientation to the top panel 36, back panel 34 and side panels 30, 32 of the firebox 24 in the manner shown in FIG. 3. A damper 50, in the form of a plate-like cover, is hinged to the damper plate 46 adjacent the opening 48 thereof for movement between a closed position, illustrated in solid lines in FIG. 3, at which the damper plate opening 48 is covered by the damper 50 and an opened position, illustrated in phantom in FIG. 3, at which the damper plate opening 48 is uncovered. A damper rod 52 is joined at one end to the damper 50 and joined at its other end to an accessible handle 54 for providing means by which the damper 50 may be manually moved between its opened and closed positions. If it is desired that the combustion products are routed entirely through the combustor assembly 22, the damper 50 is moved to its (FIG. 3) closed condition. Alternatively, if it is desired that at least a portion of the combustion products bypass the combustor assembly 22 en route to the exhaust outlet 28, the damper 50 is moved to its (FIG. 3) opened condition.

With reference to FIG. 3–6, the combustor assembly 22 includes a top plate 60, a bottom plate 62, a front 64, a back 66, and two opposite sides 68, 70 which are joined together to form a substantially rectangular enclosure 72. The top plate 60 is sized so as to span the width of the firebox cavity 26 and defines a circular opening 76 adjacent its front edge. In addition, the top plate 60 is connected between the front panel 35 and the damper plate 46 in the manner shown in FIG. 3 so that gaseous combustion products which flow toward the exhaust outlet 28 by way of the combustor assembly 22 must pass through the circular opening 76 in the top plate 60 before reaching the exhaust outlet 28. The front 64 of the assembly 22 also spans the width of the firebox cavity 26 and, as shown in FIG. 3, has a front surface which is exposed to room air which may pass through the front panel openings 39. Both the front 64 and top plate 60 are suitably attached to the side panels 30, 32 of the firebox 24, as with welds.

To enable combustion gases to flow into the combustion assembly 22, each of the sides 68, 70 and back 66 of the enclosure 72 is perforated so as to provide a plurality of apertures 74 therealong. The apertures 74 provide the only passageways by which gaseous combustion products generated within the firebox cavity 26 may flow to the circular opening 76 in the top plate 60. Consequently, when the damper 50 is closed, all of the combustion products which flow from the firebox cavity 26 toward the exhaust outlet 28 must pass through the apertures 74 provided in the enclosure back 66 and sides 68, 70.

Figure 6:
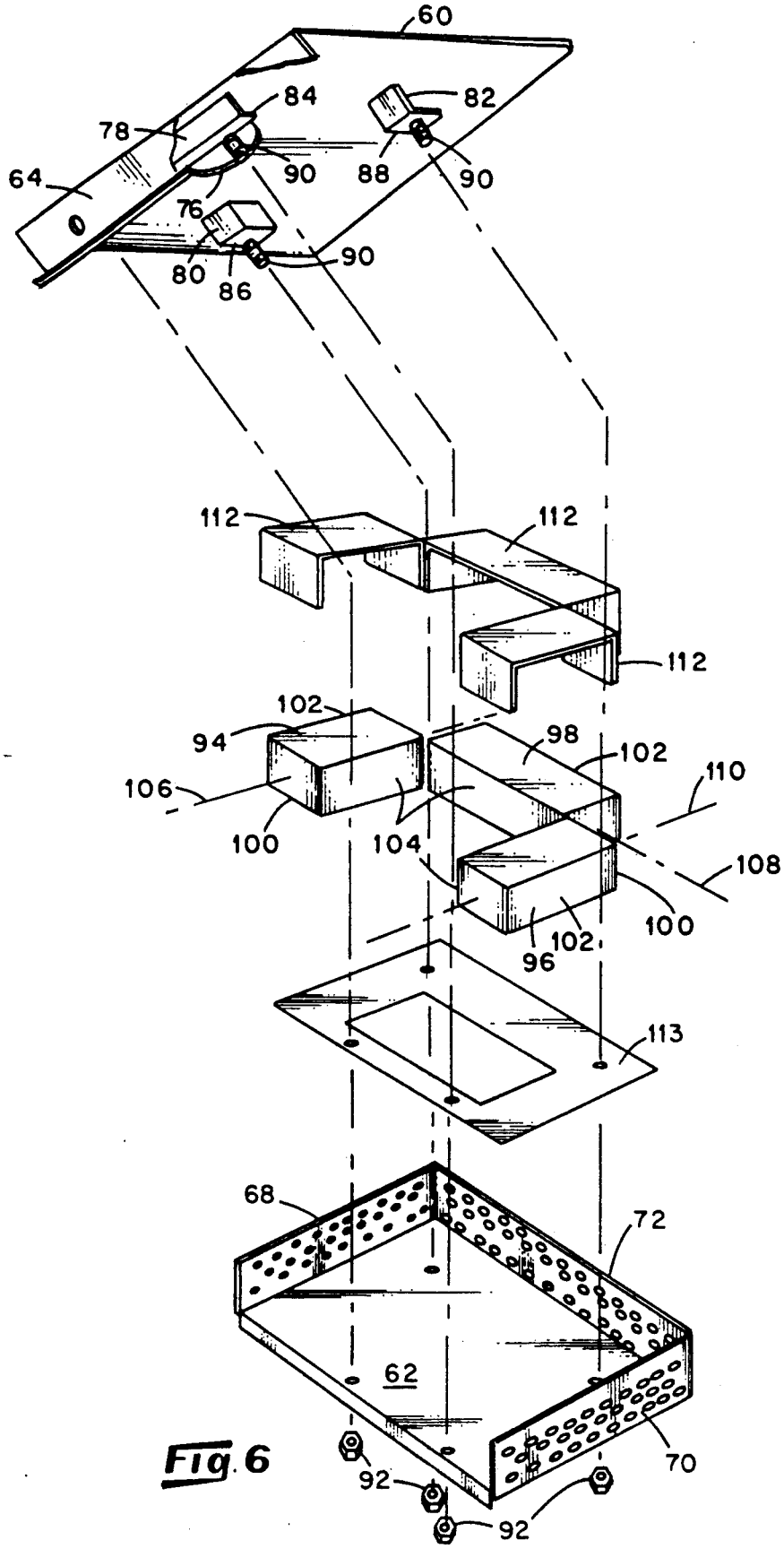
FIG. 6 is a perspective view of the FIG. 4 combustor assembly, shown exploded.

As best shown in FIG. 6, the front 64 and top plate 60 have been integrally formed as a single unit by bending a steel blank along a single fold line, and the back 66, sides 68, 70 and bottom plate 62 have been integrally formed as a single unit by bending a steel blank along three suitable fold lines. Angle members 78, 80, 82 are welded to the underside of the top plate 60 to provide bolt plates 84, 86, 88, respectively, for engaging the upper surface of the bottom plate 62, and bolts 90 and nuts 92 join the bolt plates 84, 86, 88 to the bottom plate 60 to thereby join the top plate 60 and bottom plate 62.

The combustor assembly 22 also includes three identical combustors 94, 96, 98 positioned within the enclosure 72 for controlling the pollutants routed through the assembly 22. Each combustor 94, 96 or 98 includes an elongated, substantially box-like housing 100 having a longitudinal axis 106, 108 or 110 and having a planar upstream side 102 through which gaseous products enter the combustor 94, 96 or 98 and an opposite planar downstream side 104 through which gaseous products exit the combustor 94, 96 or 98. In the depicted assembly 22, the upstream and downstream sides 102, 104 of each combustor 94, 96 or 98 are planar and parallel to one another and substantially parallel to the longitudinal axis 106, 108 or 110 of the corresponding combustor housing 100.

Examples of combustors possessing the aforedescribed characteristics (e.g., box-like housings and opposite upstream and downstream sides which are generally parallel to one another) are available from Corning Glass Works, Corning, N.Y., under the trade designation Long Life, from Technical Glass Products under the trade designation Honeycomb and from Applied Ceramics Inc., Atlanta, Ga., under the trade designation Versagrid. It will be understood, however, that the principles of the present invention are not limited to these brands of combustors.

To enhance the pollutant-controlling capabilities of the combustor assembly 22 and with reference to FIGS. 2–5, a secondary air tube 114 is positioned about the enclosure 72 for conducting room air to the gaseous combustion products upstream of the combustors 94, 96, 98. In the depicted assembly 22, the air tube 114 is hollow and includes two open ends 116, 118 and is substantially U-shaped in form. A plurality of openings 120 are disposed along the length of the tube 114, and the tube 114 extends through and is supported by the front 64 of the enclosure 72 so that the tube ends 116, 118 are in flow communication with room air through the front panel openings 39. The tube 114 extends generally along the sides 68, 70 and back 66 of the enclosure 72 so that air which enters the tube ends 116, 118 is distributed through the tube openings 120. During operation of the heater 20, room air is drawn through the tube openings 120 by way of the tube ends 116, 118 to regions adjacent the apertures 74 provided in the enclosure sides 68, 70 and back 66, and thus, to locations immediately upstream of the combustors 94, 96, 98. Thus, gaseous combustion products which move toward the combustor assembly 22 are mixed with room air prior to entering the upstream sides 102 of the combustors.

Figure 7:
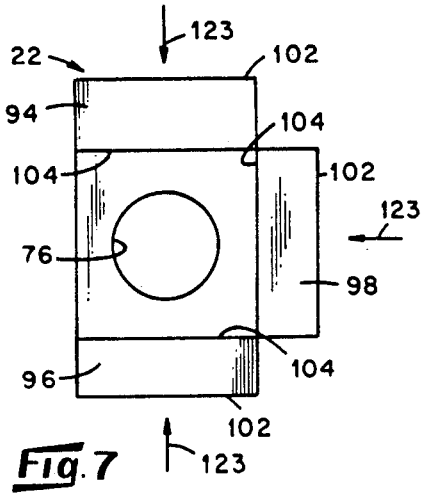
FIG. 7 is a schematic representation of the arrangement of combustors in the FIG. 4 combustor assembly.

With reference again to FIG. 6, it is a feature of the combustor assembly 22 that the combustors 94, 96, 98 are arranged within the assembly enclosure 72 in a parallel flow relationship with one another and so that the downstream side 104 of each combustor 94, 96 or 98 is fully exposed to the downstream side 104 of every other combustor in the assembly 22. In other words, the combustors 94, 96, 98 are so disposed that an imaginary line may be traced from any location on the downstream side 104 of one combustor 94, 96 or 98 to any location on the downstream side 104 of any other combustor 94, 96 or 98. To this end, the combustors 94, 96, 98 are arranged in a U-shaped configuration, as viewed in the plan view of FIG. 5 and the schematic view of FIG. 7, between the top plate 60 and bottom plate 62 so that the upstream side 102 of each combustor 94, 96 or 98 generally faces a corresponding side 68, 70 or back 66 of the enclosure 72. Thus, the downstream sides 104 are positioned in close proximity to one another and about a common space so that combustion products which exit the downstream sides 104 enter the common space before passing through the top plate opening 76.

In addition, the longitudinal axes 106, 108, 110 of the combustors 94, 96, 98 are arranged in a common plane 126 (FIG. 3), and the plane of each downstream side 104 is oriented perpendicular to the plane 126 containing the longitudinal axes 106, 108, 110. In the depicted heater 20 within which the top and bottom plates 60, 62 of the combustor assembly 22 are oriented substantially horizontally, the plane 126 containing the longitudinal axes 106, 108, 110 is oriented substantially horizontally and the plane of each downstream side 104 is oriented substantially vertically.

In order that gaseous combustion products which enter the apertures 74 provided in the sides 68, 70 and back 66 of the enclosure 72 are conducted through, rather than around, the combustors 94, 96, 98 as the products move toward the circular opening 76 provided in the top plate 60, the combustor housings 100 are sandwiched between the top and bottom plates 60, 62 of the enclosure 72, at least one corner of each housing 100 is positioned adjacent a corner of an adjacent housing 100, and one end of each of opposite combustors 94 and 96 is positioned adjacent the front 64 of the enclosure 72. Preferably, suitable gaskets 112, 113 (FIG. 6) are appropriately positioned about the housings 100 so as to seal the space between the housings 100 and top plate 60, between the housings 100 and bottom plate 62, between adjacent corners of the combustor housings 100, and between the enclosure front 64 and the corresponding end surfaces of the combustors 94, 96.

During use of the heater 20 and with reference again to FIGS. 3 and 4, gaseous combustion products flow from the firebox cavity 26 in the direction of flow arrows 122 and into the combustor assembly 22 through the apertures 74 provided in the enclosure sides 68, 70, and back 66. Upon passing through the enclosure sides 68, 70 and back 66, the combustion products enter the upstream sides 104 of the combustors 94, 96, 98 in the direction of corresponding flow arrows 123 (FIG. 7) where particulate material, such as hydrocarbons, are burned by well-known chemical processes. The combustion products then exit the combustors 94, 96, 98 through the downstream sides 104 and flow, for example, in the direction of flow arrow 124 (FIG. 3) toward the top plate opening 76. It follows that with the downstream sides 104 of the combustors 94, 96, 98 arranged about a common space provided between the top and bottom plates 60, 62 of the enclosure 72, the combustion products which exit the downstream sides 104 enter this common space before flowing through the top plate opening 76. Upon passing through the plate opening 76, the combustion products flow in the direction of the flow arrow 128 (FIG. 3) toward the exhaust outlet 28.

The aforedescribed exposure of the downstream sides 104 of the combustors 94, 96, 98 to one another is advantageous in that each downstream side 104 is exposed to the radiant heat generated by the other downstream sides 104. In addition, the common space provided between the enclosure top and bottom plates 60, 62 and into which combustion products exit the combustors 94, 96, 98 is normally very hot during heater operation and promotes the exposure of combustion products which exit one combustor 94, 96 or 98 to the downstream side 104 of the other combustors in the assembly 22.

Because each downstream side 104 is in a position for receiving radiant heat generated from the other downstream sides 104 and for receiving heat, primarily by convection, from the combustion products which exit the other downstream sides 104, the temperatures of the downstream sides 104 operate and are maintained at relatively high levels. Such high operating temperatures have been found to exist at both low and high fuel burn rates so that the pollutant-controlling effectiveness of the assembly 22 is enhanced at both the high and low fuel burn rates. Moreover, the high temperature levels of the common space provided downstream of the combustor sides 104 and between the top and bottom plates 60, 62 promote continuing combustion external to (i.e., downstream of) the combustors 94, 96, 98 and are advantageous in this respect.

Figure 8:
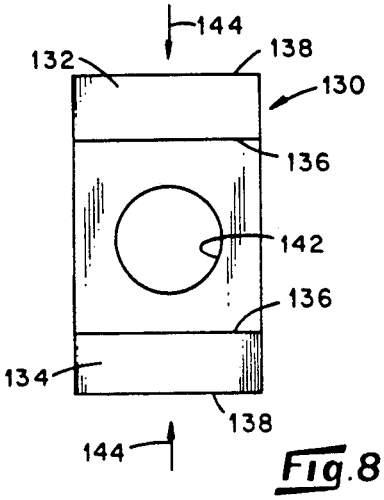
FIG. 8–11 are views similar to that of FIG. 7 which schematically illustrate the arrangement of combustors in alternative combustor assemblies.

With reference to FIGS. 8–11, there is schematically illustrated in plan view various combustor arrangements for alternative combustor assemblies and the relationship of the combustors in the assemblies to one another and to the discharge opening provided in the assembly. FIG. 8, for example, schematically illustrates a combustor assembly 130 having a pair of combustors 132, 134 having planar downstream sides 136 which are positioned so as to face one another and planar upstream sides 138. The combustors 132, 134 are supported by an assembly enclosure within which is defined a discharge opening 142 and which is adapted to direct combustion products which enter the assembly 130 in a direction into the combustor upstream sides 138 which corresponds to the direction of corresponding (i.e., adjacent) flow arrows 144. The combustion products which exit the downstream sides 136 of the combustors 132, 134 enter the common space provided between the downstream sides 136 before flowing out through the discharge opening 142.

Figure 9:
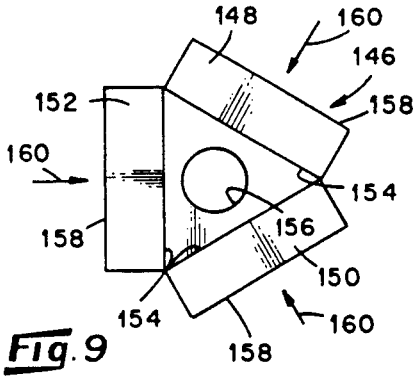

Furthermore, there is schematically illustrated in FIG. 9 a combustor assembly 146 having three combustors 148, 150, 152 having planar downstream sides 154 which are positioned in a corner-to-corner relationship so as to provide a common space therebetween having a substantially triangular cross section, as viewed in the plan view of FIG. 9. The combustors 148, 150, 152 are supported by an assembly enclosure within which is defined a discharge opening 156 and which is adapted to direct combustion products which enter the assembly 146 in a direction into the combustor upstream sides, indicated 158, which corresponds to the direction of corresponding flow arrows 160.

Figure 11:
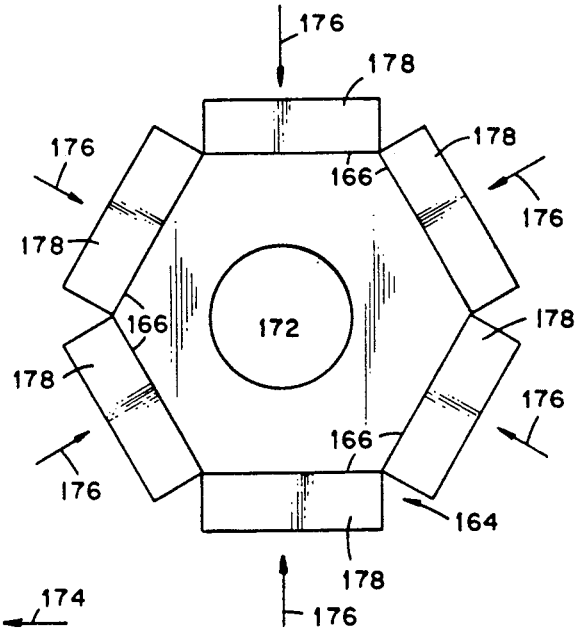
Figure 10:
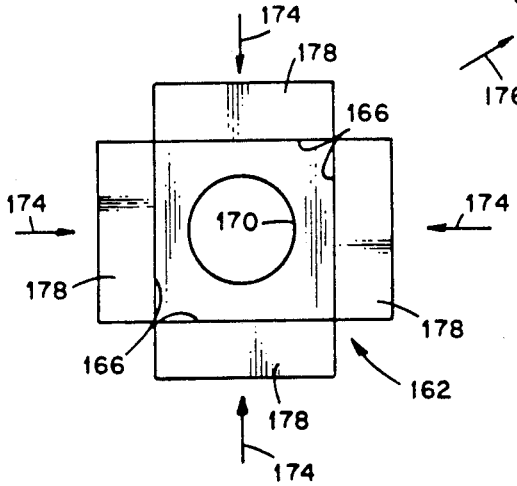

Similarly, there is schematically illustrated in FIGS. 10 and 11 combustor assemblies 162, 164, respectively, having four or six combustors 178 with downstream sides 166 which are positioned in a corner-to-corner relationship so as to provide a common space therebetween. In particular, the four combustors 178 of the FIG. 10 assembly 162 are arranged so that the downstream sides 166 provide a common space therebetween having a substantially square cross section, and the six combustors 178 of the FIG. 11 assembly 164 are arranged so that the downstream sides 166 provide a common space therebetween having a substantially hexagonal cross section. The combustors of the assembly 162 or 164 are supported by an enclosure within which is defined a discharge opening 170 or 172 and which directs the flow of combustion products into the corresponding combustors 178 in directions which correspond to the directions of corresponding flow arrows 174 or 176.

It follows that the aforedescribed combustor assemblies of FIGS. 1–11 accomplish the intended objectives of the invention. More specifically, combustor assemblies have been described which utilize a plurality of combustors compactly arranged in parallel flow relationship and which have downstream sides which are exposed to one another. The downstream sides are positioned in close proximity to one another and open into a common space so that the temperature levels of the downstream sides and combustion products entering the common space contribute to a high operating temperature of the combustors and to the pollutant-controlling effectiveness of the combustor assembly at both high and low fuel burn rates.

It will be understood that numerous modifications and substitutions can be had to the aforedescribed embodiments without departing from the spirit of the invention. Accordingly, the aforedescribed embodiments are intended for the purpose of illustration and not as limitation.

We claim:

1. A pollutant-controlling combustor assembly for use with a fuel-burning room heater so that gaseous combustion products which are generated within the heater are directed through the assembly before being discharged into the atmosphere, said assembly comprising:

at least two combustors each having an upstream side through which combustion products enter the combustor and a downstream side through which combustion products exit the combustor; and means for supporting said combustors in parallel flow relationship with one another so that a stream of combustion products flowing through one combustor is prevented from mixing with a stream of combustion products flowing through any other combustor in said assembly while each stream moves between the upstream and downstream sides of its corresponding combustor and so that the downstream side of one combustor in said assembly is facing the downstream side of another combustor in said assembly for receiving radiant heat generated by the downstream side of said another combustor.

2. The assembly as defined in claim 1 wherein the downstream side of each combustor in said assembly is fully exposed to the downstream side of every other combustor in said assembly so that an imaginary line can be traced from any location on the downstream side of any combustor to any location on the downstream side of any other combustor in said assembly.

3. The assembly as defined in claim 1 wherein the downstream sides of the combustors are positioned in relatively close proximity to one another and about a common space so that gaseous combustion products which exit the downstream sides flow into the common space.

4. The assembly as defined in claim 1 wherein the downstream side of each combustor is elongate and planar in form with two opposite ends, and the combustors in the assembly are arranged so that an end of the downstream side of one combustor is positioned adjacent an end of the downstream side of another combustor so that the downstream sides of said one combustor and said another combustor are angularly disposed.

5. The assembly as defined in claim 1 wherein each combustor has a box-like housing which is substantially elongate in form and the combustors are arranged so that the longitudinal axes of the combustor housings lie in a common plane.

6. The assembly as defined in claim 5 wherein the downstream side of each combustor is substantially planar and oriented generally perpendicular to the common plane within which lies the longitudinal axes of the housings.

7. The assembly as defined in claim 1 wherein said downstream sides are positioned about a common space and the means for supporting includes enclosure means which cooperates with the combustors to substantially enclose the common space about which the downstream sides are positioned and said enclosure means includes a discharge opening in flow communication with the common space so that gaseous combustion products which exit the downstream sides flow into the common space and then through said discharge opening.

8. The assembly as defined in claim 7 wherein said enclosure means includes a pair of plates between which the combustors are positioned and said discharge opening is provided in one of said plates.

9. A pollutant-controlling combustor assembly for use with a fuel-burning room heater so that gaseous combustion products which are generated within the heater are routed through the assembly before being discharged into the atmosphere, said assembly comprising:

a plurality of combustors each including a box-like housing having an upstream side through which combustion products enter the housing and an opposite downstream side through which combustion products exit the housing; and means for supporting said plurality of combustors in parallel flow relationship with one another so that a stream of combustion products flowing through one combustor is prevented from mixing with a stream of combustion products flowing through any other combustor in said assembly while each stream moves between the upstream and downstream sides of its corresponding combustor and so that the downstream side of each combustor having is facing the downstream side of every other combustor housing in said assembly so that the downstream side of each combustor housing is in position to receive radiant energy generated by the downstream sides of the other combustors in said assembly, the downstream sides being supported by said supporting means in position about a common space so that combustion products which exit the downstream sides of the combustor housings enter the common space.

10. The assembly as defined in claim 9 wherein the downstream side of each combustor housing is elongate and planar in form with two opposite ends, the housing of each combustor has a corner at each end of its downstream side and the combustor housings are arranged in a corner-to-corner fashion so that one end of the downstream side of one combustor housing is positioned adjacent an end of the downstream side of another combustor housing.

11. The assembly as defined in claim 9 wherein the downstream side of each combustor housing is substantially planar, each housing is elongate in form and the combustors are arranged so that the longitudinal axes of the combustor housings lie in a common plane and each plane of the housing downstream sides is oriented generally perpendicular to the common plane within which lies the longitudinal axes of the housings.

12. The assembly as defined in claim 9 wherein the means for supporting includes enclosure means which cooperates with the combustor housings to substantially enclose the common space about which the downstream sides are positioned and said enclosure means includes a discharge opening in flow communication with the common space so that gaseous combustion products which exit the downstream sides flow into the common space and then through said discharge opening.

13. The assembly as defined in claim 9 wherein said enclosure means includes a pair of plates between which the combustors are positioned and said discharge opening is provided in one of said plates.

14. In combination with a firebox for a fuel-burning room heater which includes a cavity within which fuels are burned and gaseous combustion products are generated and means defining an exhaust outlet through which the gaseous combustion products exit the firebox, a pollutant-controlling combustor assembly disposed between the firebox cavity and the exhaust outlet so that as gaseous combustion products flow from the firebox cavity toward the exhaust outlet, the combustion products are conducted through the combustor assembly, said combustor assembly including:

at least two combustors each including an upstream side through which combustion products enter the combustor and a downstream side through which combustion products exit the combustor; and means for supporting the combustors adjacent the firebox cavity so that a stream of combustion products flowing through one combustor is prevented from mixing with a stream of combustion products flowing through any other combustor in said assembly while each stream moves between the upstream and downstream sides of its corresponding combustor and so that the combustors are in parallel flow relationship with one another and so that the downstream side of one combustor in said assembly is facing the downstream side of another combustor in said assembly for receiving radiant heat generated by the downstream side of said another combustor.

15. The combination of claim 14 wherein the downstream side of each combustor in said assembly is fully exposed to the downstream side of every other combustor in said assembly so that an imaginary line can be traced from any location on the downstream side of any combustor to any location on the downstream side of any other combustor in said assembly.

16. The combination of claim 14 wherein the downstream sides of the combustors are positioned in relatively closed proximity to one another and about a common space so that gaseous combustion products which exit the downstream sides flow into the common space.

17. The combination of claim 14 wherein the downstream side of each combustor is elongate and planar in form with two opposite ends, and the combustors in the assembly are arranged so that an end of the downstream side of one combustor is positioned adjacent an end of the downstream side of another combustor so that the downstream sides of said one combustor and said another combustor are angularly disposed.

18. The combination of claim 14 wherein each combustor has a box-like housing which is substantially elongate in form and the combustors are arranged so that the longitudinal axes of the combustor housings lie in a common plane.

19. The combination of claim 18 wherein the downstream side of each combustor is substantially planar and oriented generally perpendicular to the common plane within which lies the longitudinal axes of the housings.

20. The combination of claim 14 wherein the means for supporting includes enclosure means which cooperates with the combustors to substantially enclose the common space about which the downstream sides are positioned and said enclosure means includes a discharge opening in flow communication with the common space so that gaseous combustion products which exit the downstream sides flow into the common space and then through said discharge opening.

* * * * *